United States Patent [19]

Eppenbach

[11] Patent Number: 4,491,141

[45] Date of Patent: Jan. 1, 1985

[54] TENT

[76] Inventor: Lawrence C. Eppenbach, 419 Kennedy St., Juneau, Ak. 99801

[21] Appl. No.: 470,965

[22] Filed: Mar. 1, 1983

[51] Int. Cl.[3] ..... A45F 1/16

[52] U.S. Cl. ..... 135/104; 135/87; 5/414

[58] Field of Search ..... 135/104, 93, 115, 119, 135/21, 87, 90, 117, 109, 901; 5/414; D21/253

[56] References Cited

U.S. PATENT DOCUMENTS

| | | | |
|---|---|---|---|
| 373,809 | 11/1887 | Blunt | 5/414 |
| 657,369 | 9/1900 | Strauss | 135/104 |
| 1,079,757 | 11/1913 | Gould | 135/117 |
| 2,475,515 | 7/1949 | Potter | 135/104 |
| 2,771,087 | 11/1956 | Simonson | 135/104 |
| 3,609,905 | 10/1971 | Fuhrman et al. | 135/901 |
| 3,913,598 | 10/1975 | Glutting et al. | 135/87 |

*Primary Examiner*—Richard J. Apley
*Assistant Examiner*—S. R. Crow
*Attorney, Agent, or Firm*—Gordon L. Peterson

[57] ABSTRACT

A tent comprising a flexible porous sheet having an inner face and an outer face and a resilient frame attached to the sheet. The resilient frame is stressed so that the frame can shape the sheet into an enclosure having a peripheral wall, a closed top, an opening at the front, and a shroud for closing the opening. The shroud is of substantially greater length than the height of the opening. A peripheral region of the sheet extends from the perimeter of the enclosure to form a seal with the surface which supports the tent.

15 Claims, 7 Drawing Figures

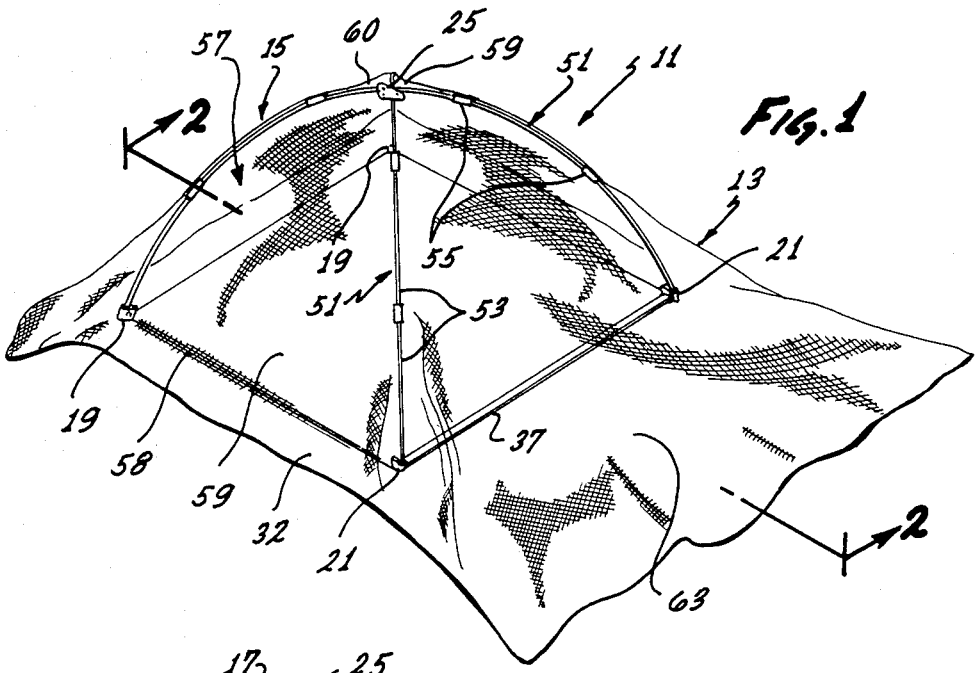
Fig. 1
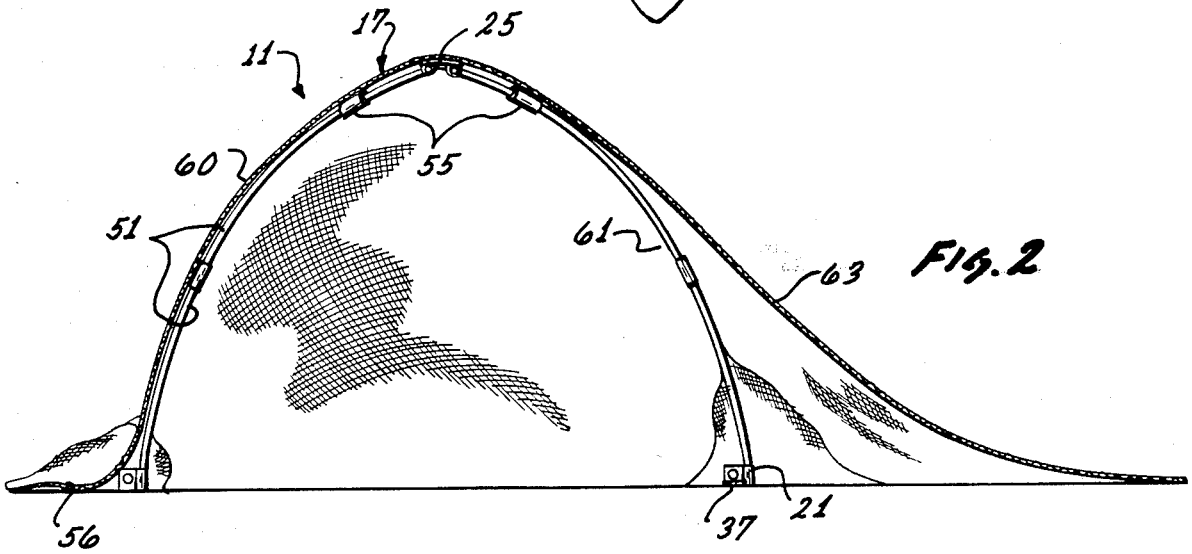
Fig. 2
Fig. 3
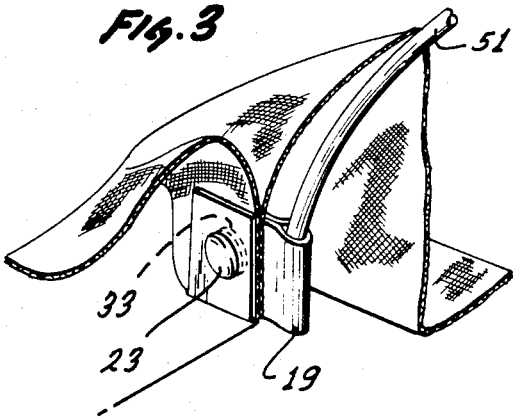
Fig. 4
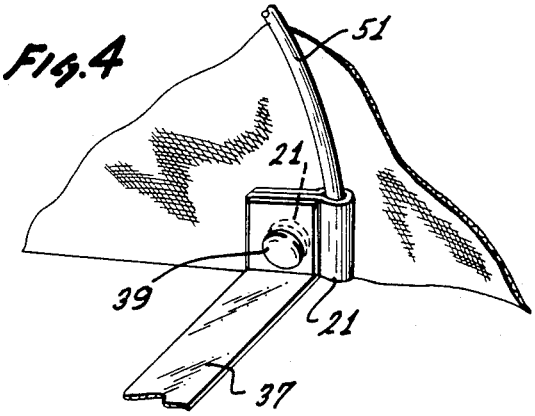

TENT

BACKGROUND OF THE INVENTION

There are numerous circumstances in which flying and/or crawling insects can be a nuisance, or even pose a threat, to a person attempting to sleep. For example, mosquitoes are a common annoyance to campers and those traveling to parts of the earth where mosquitoes are found in abundance indoors. In other instances, poisonous insects, such as certain species of spiders, pose a threat to persons attempting to sleep.

Perhaps the most common way to address the mosquito problem is to apply a mosquito repellant. Although mosquito repellant is to some extent satisfactory, care must be taken not to get it in the eyes, it often has an unpleasant odor, and its effectiveness is of a limited duration following its application.

It is also known to use mosquito netting in an effort to shield a person from mosquitoes. Although mosquito netting can be effective, in many, if not most situations, there is no way to drape the netting over the person sleeping, and it is difficult to seal around the edges of the netting so as to positively exclude insects.

SUMMARY OF THE INVENTION

This invention provides a lightweight, inexpensive and very compact tent which is particularly adapted for shielding a person in a reclined position from flying and crawling insects. Although the tent of this invention is particularly adapted for this purpose, the tent can, if desired, be used for other purposes, such as sheltering a person from the elements.

The tent generally comprises a flexible sheet having an inner face and an outer face, a resilient frame and means for attaching the frame to the sheet with the frame engaging the inner face of the sheet. The resilient frame can be stressed so that the frame can shape the sheet into an enclosure having a peripheral wall, a closed top, an opening at the front and a flap for closing the opening.

For a tent that is to be used primarily as an insect shield, the sheet is preferably entirely porous to allow the passage of air therethrough, but with the pores being too small to allow passage of mosquitos, and the like, into the interior of the enclosure. The enclosure is preferably sufficiently large to receive the head and upper body of a person in a reclined position. To provide a better insect seal, the flap is preferably greatly enlarged with respect to the front opening so that it forms a shroud which can close the opening and extend outwardly from the perimeter of the enclosure. The shroud can then be tucked around the mid-section of the person using the tent to form an effective insect shield. To impede insects attempting to enter the enclosure at the base of the enclosure, a peripheral region of the sheet extends from the perimeter of the enclosure to form a peripheral flap or seal which can engage the supporting surface, such as the ground or a bed, on which the tent is placed. The seals referred to above significantly impede insect entrance into the interior of the enclosure.

The tent of this invention can be embodied in a construction which is extremely simple. For example, the flexible sheet can be of one-piece construction which can be laid out flat. Accordingly, it can be folded into a very small package to aid portability of the tent and it can be used as conventional mosquito netting when desired.

To permit the flexible sheet to be appropriately shaped by the frame, the sheet has a plurality of bearings mounted on the inner face thereof in a polygonal pattern. Each of these bearings is adapted to coact with an associated end portion of the frame. For example, in a preferred construction, there are four of the bearings arranged in a rectangular pattern, and the frame comprises first and second frame members diagonally intersecting with their end portions received by the four bearings, respectively.

To partially stress the resilient frame so that it can shape the flexible sheet, fastener means is provided on at least one of the bearings and an adjacent region of the sheet whereby the bearing can be coupled to such region of the sheet. In a preferred construction, two of the bearings are coupled to associated regions of the sheet. Further stressing of the frame can be obtained by stressing the frame across the front opening. This can be accomplished, for example, by an elongated flexible element extending between the lower corners of the front opening and/or by folding of the sheet to form a bottom wall for the tent and appropriately attaching the bottom wall to the lower corners of the opening. With this construction, the frame members can be quickly attached to the bearings, and the fasteners can be quickly coupled together to assemble the tent.

The invention, together with additional features and advantages thereof, may best be understood by reference to the following description taken in connection with the accompanying illustrative drawing.

BRIEF DESCRIPTION OF THE DRAWING

FIG. 1 is a perspective view of one form of tent constructed in accordance with the teachings of this invention.

FIG. 2 is a sectional view taken generally along line 2—2 of FIG. 1.

FIG. 3 is a fragmentary perspective view illustrating the right rear corner of the tent.

FIG. 4 is a fragmentary perspective view illustrating the right front corner of the tent.

DESCRIPTION OF THE PREFERRED EMBODIMENT

Figure 6:
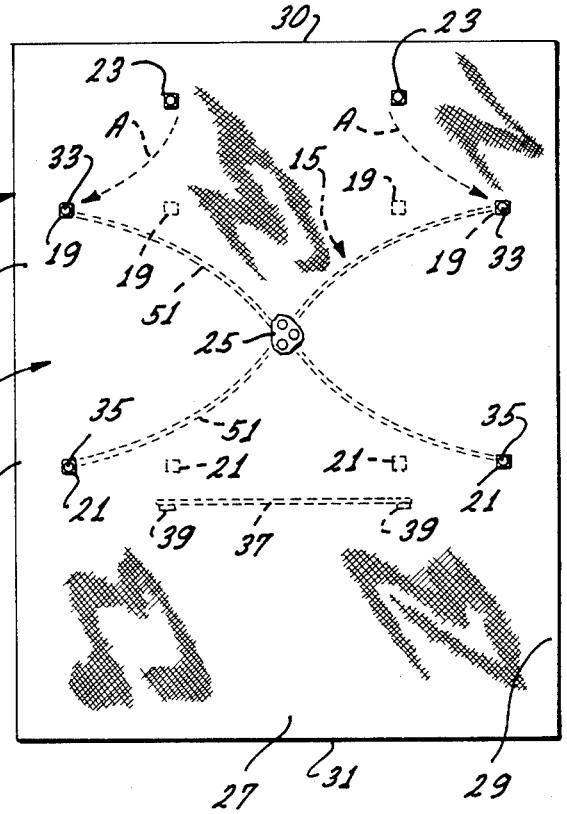
FIG. 6 is a plan view of the flexible panel used to form the tent with the phantom lines illustrating other components of the tent.

FIG. 1 shows a tent 11 which generally comprises a flexible panel 13 (FIGS. 1 and 6) and a frame 15. As best shown in FIG. 6, the panel 13 comprises a flexible, porous sheet 17, rear bearings 19, forward bearings 21, fastener elements 23 and a frame attachment 25. To simplify construction, the sheet 17 is preferably constructed of a single, integral seamless piece of porous, transparent netting having an inner face 27 and an outer face. Although the sheet 17 can be of different configurations, for simplicity, it can be rectangular and comprise generally parallel, longitudinal edges 29 and shorter, parallel rear and front edges 30 and 31, respectively.

The bearings 19 and 21 are suitably attached to the sheet 17 and lie on the inner face 27. The bearings 19 and 21 engage and support the ends of the frame 15 and, as such, may be of any suitable number and construction to accomplish this function. The bearings 19 and 21 are arranged in a polygonal pattern, and in the embodiment illustrated, this pattern is rectangular. Although different orientations are possible, in the illustrated embodiment of FIG. 6, the long dimensions of the rectangular pattern are parallel to the edges 30 and 31 and the short dimensions of the rectangular pattern are parallel to the longitudinal edges 29.

The polygonal pattern of the bearings 19 and 21 is spaced inwardly from the periphery of the sheet so that the pattern is circumscribed by a peripheral region 32 of the sheet. Specifically, the bearings 19 and 21 are spaced inwardly from the adjacent longitudinal edge 29 equal distances, and the fastener elements 23 are spaced inwardly from the rear edge 31 an equal amount. The polygonal pattern of the bearings 19 and 21 is closer to the rear edge 30 than to the forward edge 31.

Although the bearings 19 and 21 may be of various different constructions, in the form illustrated, each of them is in the form of a pocket formed by a strap folded on itself and having its bottom closed and its top open to receive an end portion of the frame 15. The loops which form the bearings 19 and 21 are fastened or adhered to the inner face 27 of the sheet 17. Each of the bearings 19 and 21 has a fastener element 33 and 35, respectively, attached to the strap which forms the bearing. The fastener elements 23, 33 and 35 may be, for example, snap fasteners.

The fastener elements 23 are adapted to releasably interlock with the adjacent fastener elements 33 as shown in FIG. 3. The fastener elements 23 are attached to the inner face 27 of the sheet 17 as by an adhesive and are preferably located outside of the polygonal pattern of the bearings 19 and 21. Also, the fastener elements 23 are closer together than the fastener elements 33 so that, when these fastener elements are interlocked as shown in FIG. 3, the frame 15 is stressed or tensioned as described more fully hereinbelow.

To additionally stress the frame 15, the panel 13 includes an elongated flexible member 37 (FIGS. 1, 4 and 6) for drawing the bearings closer together. The flexible member 37 has fastener elements 39 at its opposite ends for releasably coupling the flexible member to the fastener elements 35 carried by the bearings 21. To stress the forward portion of the frame 15 equally with the rear portion, the flexible member 37 should have a length approximately equal to the distance between the fastener elements 23.

Figure 5:
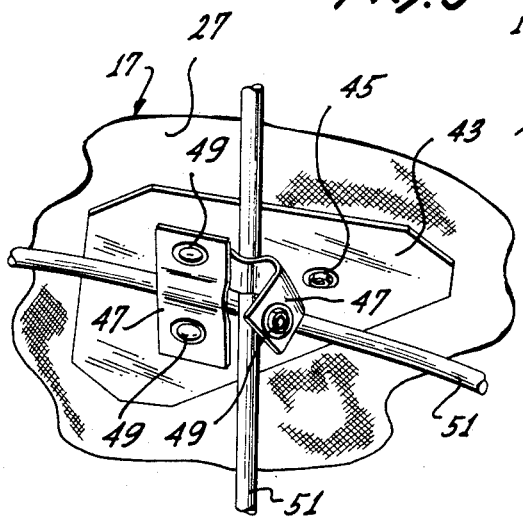
FIG. 5 is a fragmentary perspective view of a central region of the interior top wall of the tent.

The frame attachment 25 comprises a web 43 (FIG. 5) of a suitable fabric adhered to the inner face 27. of the sheet 17 and carrying fastener elements 45 in the form of snap fasteners (FIG. 5). Two flexible fabric tabs 47 are releasably attached to the web 43 by snap fastener elements 49.

Although the frame 15 may be of different constructions, in the illustrated embodiment, it comprises first and second resilient frame members 51 which diagonally intersect to form an "X." To enhance portability, each of the frame members 51 preferably comprises a plurality of short segments 53 held together by conventional couplings 55 which receive end portions of the segments 55.

To assemble the tent, the sheet 17 is laid out flat, with the inner face 27 facing inwardly as shown in FIG. 6. The opposite ends of the frame members 51 are inserted into the diagonally opposite bearings 19 and 21, and the tabs 47 are snapped to the fastener elements 45 to secure these tabs around the central regions of the frame members to hold them against the inner face 27. Each of the frame members 51 is slightly longer than the diagonal distance between the associated bearings 19 and 21, and accordingly, when laid out flat, the frame members 51 bow somewhat as illustrated in FIG. 6.

Next, the fastener elements 23 are attached to the associated fastener elements 33 as shown by the arrows A in FIG. 6. The effect is to draw the bearings 19 to the dashed position shown in FIG. 6 thereby bowing the frame members 51 concavely upwardly and stressing the frame members.

Next, the flexible member 37 is attached via the fastener elements 35 and 39 to the bearings 21 to move the bearings 21 toward each other to the dashed position shown in FIG. 6 thereby further stressing and tensioning the frame members 51. The tent 11 is then inverted to the position shown in FIG. 1 and placed on a suitable supporting surface 56 (FIG. 2).

The tent 11 includes an enclosure 57 (FIG. 1) having a peripheral wall extending upwardly from a base 58 and including opposite side walls 59 and a rear or end wall 60. The top of the enclosure 57 is closed. Each of the side walls 59 is between an adjacent pair of the bearings 19 and 21, and the rear wall 60 is between the bearings 19. The tent 11 has an opening 61 at the front and an openable flap in the form of a shroud 63 for closing the opening. The shroud 63 is of substantially greater length than the height of the opening 61 so that the shroud can close the opening and extend outwardly from the base of the enclosure 57 for a substantial distance as shown in FIGS. 1 and 2. The flexible member 37 extends across the bottom of the opening 61 between the lower corners of the opening. The relatively large spacing between the bearings 21 and the forward edge 31 provide the shroud 63 with its additional length.

The peripheral region 32 of the sheet 17 extends outwardly from the side walls 59 and the rear wall 60 to form a seal with the supporting surface 56 on which the tent 11 rests. The peripheral region 32 may extend outwardly or inwardly from the base of the enclosure 57 as desired.

Although the tent 11 can be of any desired size, when used as an insect shield, it is preferably large enough to receive the head, shoulders and upper body of the user. In this event, the shroud 63 can be tucked around the mid-section of the person reclined within the tent, and the shroud can still seal the front opening 61. The flexible member 37 can provide its frame tensioning function without obstructing the front opening 61.

Figure 7:
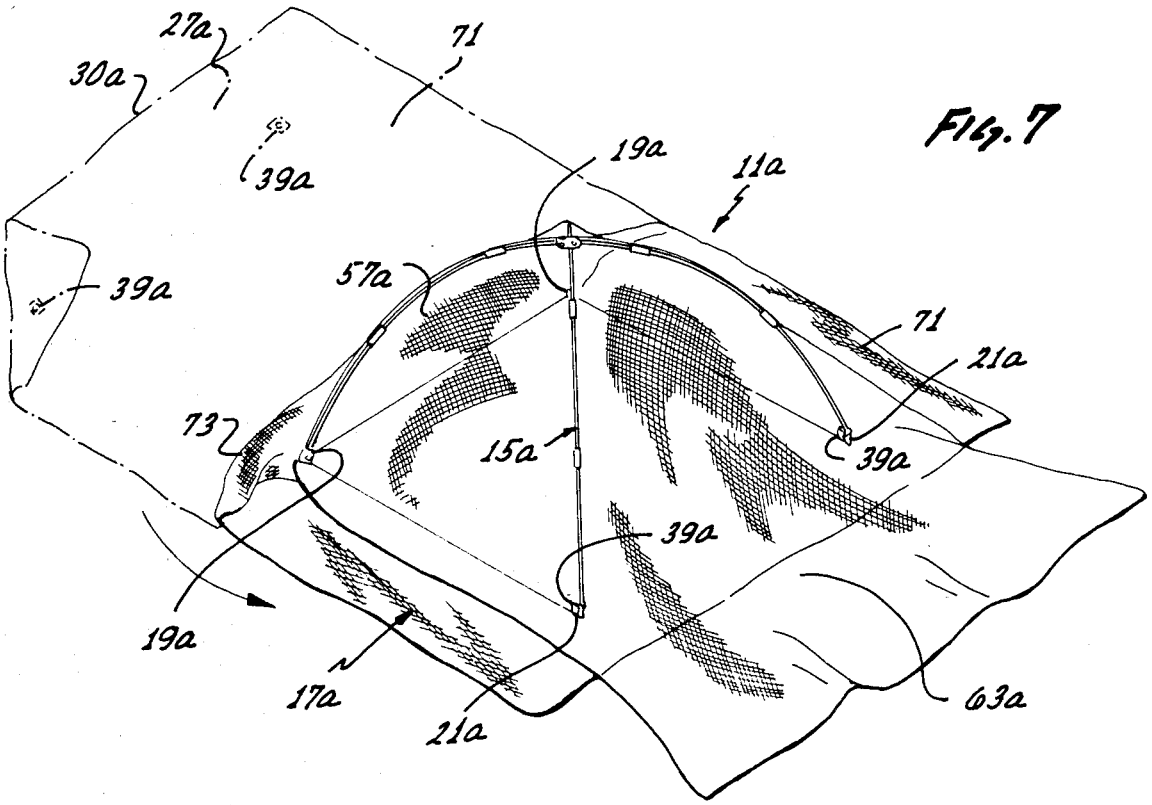
FIG. 7 is a perspective view illustrating a second embodiment of tent constructed in accordance with the teachings of this invention.

FIG. 7 shows a tent **11*a* which is identical to the tent 11 in all respects not shown or described herein. Portions of the tent 11*a* corresponding to portions of the tent 11** are designated by corresponding reference numerals followed by the letter "a.".

The only differences between the tents 11 and **11*a* are that the latter has a floor 71, the fastener elements 39*a* are attached to the floor and the flexible member 37 is not used. To form the floor 71, the sheet 17*a* is enlarged between the bearings 19*a* and the rear edge 30*a*. The fastener elements 39*a* are sewed onto the inner face 27*a* of the enlarged region as shown in FIG. 7. As the final step of tent assembly, the sheet 17*a* is folded along a region 73 just rearwardly of the enclosure 57*a* to bring the enlarged portion of the sheet 17*a* below the enclosure to form the floor 71 and to place the fastener elements 39***a* in position for attachment to the bearings 21*a*. Because the sheet 17*a* is not rectangular, the floor 71 projects outwardly of the enclosure 57.

Although exemplary embodiments of the invention have been shown and described, many changes, modifications and substitutions may be made by one having ordinary skill in the art without necessarily departing from the spirit and scope of this invention.

I claim:

1. A tent adapted to rest on a supporting surface comprising:

a flexible porous sheet having an inner face and an outer face;

a resilient frame;

means for attaching the frame to the sheet with the frame engaging the inner face of the sheet;

means for stressing the resilient frame so that the frame can shape the sheet into an enclosure having a peripheral wall, a closed top, a base, an opening at the front, and an openable shroud for closing the opening of said enclosure and being of substantially greater length than the height of said opening whereby the shroud can close the opening and extend outwardly from the base of the enclosure;

a peripheral region of the sheet extending from the base of the enclosure to impede insects from entering the enclosure at the base; and said opening having lower corners, said flexible sheet being folded to form a floor for the enclosure, portions of said floor being coupled to portions of the sheet adjacent the corners to stress the resilient frame whereby the floor forms at least a portion of the stressing means.

2. A tent adapted to rest on a supporting surface comprising:

a flexible porous sheet having an inner face and an outer face;

a resilient frame;

means for attaching the frame to the sheet with the frame engaging the inner face of the sheet;

means for stressing the resilient frame so that the frame can shape the sheet into an enclosure having a peripheral wall, a closed top, a base, an opening at the front, and an openable shroud for closing the opening of said enclosure and being of substantially greater length than the height of said opening whereby the shroud can close the opening and extend outwardly from the base of the enclosure;

a peripheral region of the sheet extending from the base of the enclosure to impede insects from entering the enclosure at the base; and said frame including first and second diagonally intersecting frame members acting against the inner surface of the sheet, each of said first and second frame members terminating in opposite end portions, said attaching means including at least four bearings on the sheet and engageable with the end portions, respectively, of the first and second frame members.

3. A tent adapted to rest on a supporting surface comprising:

a flexible porous sheet having an inner face and an outer face;

a resilient frame;

means for attaching the frame to the sheet with the frame engaging the inner face of the sheet;

means for stressing the resilient frame so that the frame can shape the sheet into an enclosure having a peripheral wall, a closed top, a base, an opening at the front, and an openable shroud for closing the opening of said enclosure and being of substantially greater length than the height of said opening whereby the shroud can close the opening and extend outwardly from the base of the enclosure;

a peripheral region of the sheet extending from the base of the enclosure to impede insects from entering the enclosure at the base;

said frame having at least first and second end portions and said attaching means including first and second bearings on said sheet for engaging the first and second end portions, respectively; and said stressing means including releasable fastener means on at least one of said bearings and an adjacent region of the sheet whereby said one bearing can be releasably coupled to said adjacent region of the sheet to stress the frame and facilitate assembly and disassembly of the tent.

4. A tent as defined in claim 3 wherein said opening has lower corners and said frame has portions adjacent the lower corners of the opening and said stressing means includes an elongated flexible member coupled to the sheet adjacent the lower corners and extending along the bottom of the opening between said lower corners, the elongated flexible member being releasably coupled to the sheet adjacent at least one of the lower corners.

5. A tent as defined in claim 2 wherein said four bearings receive the associated end portions of the frame members, said stressing means includes releasable fastener means on first and second of said bearings and first and second regions of the sheet adjacent said first and second bearings, respectively, whereby said first and second bearings can be releasably coupled to the first and second regions, said attaching means includes means on the sheet for attaching the frame to a central region of the enclosure.

6. A flexible panel for use with a frame to form a tent comprising:

a flexible sheet having an inner face and an outer face;

at least four bearings mounted on said sheet and adapted to receive end portions of the frame, respectively, said bearings being arranged in a polygonal pattern;

first and second fastener elements mounted on said sheet closely adjacent first and second of said bearings, respectively, said first and second bearings being adjacent to each other in said polygonal pattern;

third and fourth fastener elements mounted on said sheet in spaced relationship, said third and fourth fastener elements being closer together than said first and second fastener elements and being adapted to releasably couple to the first and second fastener elements, respectively, so as to stress the frame; and means for attaching regions of the sheet together adjacent third and fourth of said bearings to stress the frame whereby the frame can shape the flexible sheet to form an end wall generally between the first and second bearings, side walls generally between the first and third and second and fourth bearings, an open front generally between the third and fourth bearings, a closed top and a flap for closing the open front.

7. A flexible panel as defined in claim 6 wherein said third and fourth fastener elements are outside of said polygonal pattern.

8. A flexible panel as defined in claim 6 wherein said sheet has a rear edge and a forward edge, said polygonal pattern is closer to said rear edge than said forward edge, and said first and second bearings are generally intermediate the rear edge and the third and fourth bearings whereby said flap is substantially larger than the front opening.

9. A flexible panel as defined in claim 6 wherein said polygonal pattern is spaced inwardly from the periphery of the sheet whereby the polygonal pattern is circumscribed by a region of the sheet.

10. A flexible panel as defined in claim 9 wherein said third and fourth fastener elements are outside said polygonal pattern, said sheet has a rear edge and a forward edge, said polygonal pattern is closer to said rear edge than said forward edge, and said first and second bearings are generally intermediate the rear edge and the third and fourth bearings whereby said flap is substantially larger than the front opening and said fastener elements and bearings are on the inner face of the sheet.

11. A flexible panel as defined in claim 6 including means on the sheet for attaching the frame to a central region of the polygon.

12. A flexible panel as defined in claim 6 wherein said sheet is of one-piece construction and at least a portion of the sheet is porous.

13. A flexible panel as defined in claim 6 wherein said first bearing includes a pocket for receiving the associated end portion of the frame.

14. A tent comprising:

a flexible sheet having an inner face and an outer face;

a resilient frame having a plurality of end portions;

a plurality of bearings mounted on said sheet and adapted to coact with portions of the frame, respectively, said bearings being arranged in a polygonal pattern;

a first fastener element mounted on said sheet closely adjacent a first of the bearings;

a second fastener element adapted to be releasably coupled to the first fastener element and mounted on said sheet in a position such that when it is coupled to said first fastener element the frame is stressed; and means for attaching regions of the sheet together adjacent two adjacent bearings so as to stress the frame whereby the frame can shape the flexible sheet to form a peripheral wall, a base, an open front generally between said two bearings, a closed top and a flap for closing the open front.

15. A tent as defined in claim 14 wherein said sheet has a rear edge and a forward edge, said polygonal pattern is closer to said rear edge than said forward edge whereby the flap forms a shroud of substantially greater length than the height of said opening and the shroud can close the opening and extend outwardly from the base.

* * * * *